US006638110B1

(12) United States Patent
Billman

(10) Patent No.: US 6,638,110 B1
(45) Date of Patent: Oct. 28, 2003

(54) HIGH DENSITY ELECTRICAL CONNECTOR

(75) Inventor: Timothy B. Billman, Dover, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/154,318

(22) Filed: May 22, 2002

(51) Int. Cl.[7] ..... H01R 13/648
(52) U.S. Cl. ..... 439/608; 439/108
(58) Field of Search ..... 439/608, 108, 439/79, 76.1, 101, 701

(56) References Cited

U.S. PATENT DOCUMENTS

| | | | | | |
|---|---|---|---|---|---|
| 5,980,321 | A | | 11/1999 | Cohen et al. | |
| 5,993,259 | A | * | 11/1999 | Stokoe et al. | 439/608 |
| 6,083,047 | A | * | 7/2000 | Paagman | 439/608 |
| 6,146,202 | A | * | 11/2000 | Ramey et al. | 439/608 |
| 6,152,747 | A | | 11/2000 | McNamara | |
| 6,238,245 | B1 | * | 5/2001 | Stokoe et al. | 439/608 |
| 6,267,604 | B1 | | 7/2001 | Mickievicz et al. | |
| 6,273,762 | B1 | * | 8/2001 | Regnier | 439/701 |
| 6,293,827 | B1 | | 9/2001 | Stokoe | |
| 6,299,483 | B1 | * | 10/2001 | Cohen et al. | 439/608 |
| 6,299,484 | B2 | | 10/2001 | Van Woensel | |

OTHER PUBLICATIONS

PCB–Mounted Receptacle Assemblies, Berg Product Catalog, Jan. 1998, pp. 10–6 to 10–7 and pp. 10–16 to 10–17.
VHDM Connector, http://www.teradyne.com/prods/tcs/products/hpi/vhdm/modoconfig.html.

* cited by examiner

*Primary Examiner*—Gary Paumen
*Assistant Examiner*—James R. Harvey
(74) *Attorney, Agent, or Firm*—Wei Te Chung

(57) ABSTRACT

An electrical connector (1) includes a dielectric housing (10) defining a number of parallel channels (14), and a spacer (20) consisting of a number of wafers (21) assembled together. A number of slots (200) is defined between adjacent wafers. Each wafer includes a dielectric base (22), and a number of signal terminals (23) and a grounding bus (24) respectively mounted on opposite sides of the dielectric base. A number of circuit boards (30) is disposed between the housing and the spacer. Each circuit board has a mating portion (300) aligned with a corresponding channel of the housing, and a mounting portion (302) received in a corresponding slot of the spacer. The mounting portions of the circuit boards mechanically and electrically engage with the signal terminals and the grounding buses and do not have an engagement with the dielectric bases of the spacer.

2 Claims, 12 Drawing Sheets

HIGH DENSITY ELECTRICAL CONNECTOR

CROSS-REFERENCES TO RELATED APPLICATIONS

This patent application is a Co-pending Application of Patent Application filed May 21, 2002 with an unknown serial number with the same assignee and one common inventor, titled "ELECTRICAL CONNECTOR", which relates to U.S. Pat. Nos. 6,375,508 and 6,390,857.

BACKGROUND OF THE INVENTION

1. Field of the Invention

The present invention relates to an electrical connector, and particularly to a high density electrical connector having a plurality of circuit boards for high speed signal transmission.

2. Description of Related Art

With the development of communication and computer technology, high density electrical connectors with conductive elements in a matrix arrangement are desired to construct a large number of signal transmitting paths between two electronic devices. Such high density electrical connectors are widely used in internal connecting systems of severs, routers and the like devices requiring high speed data processing and communication.

These connectors generally comprise two mating connector halves, i.e., a plug connector connecting with a backplane and a receptacle connector connecting with a daughter card. The backplane and the daughter card are positioned in parallel or perpendicularity to each other. The mating connector halves of one type can be referred to Berg Product Catalog published on January 1998 which is submitted herewith by Information Disclosure Statement (IDS), and the website of Teradyne, Inc, at the following internet address: http://www.teradyne.com/prods/tcs/products/hpi/vhdm/modoconfig.html. A hard copy of the website is submitted herewith by IDS for reference. Each connector comprises an overmolded carrier made of dielectric material and multiple rows and columns of contacts. Each column of the contacts is provided as a separate module. Multiple modules are installed in the insulating carrier to form a complete connector. Generally, all of the modules are substantially identical. When it is desired to have different types of modules in the connector in order to meet different requirements of signal transmission, a problem is raised that additional tooling and handling are required for the different types of the modules, thereby increasing manufacturing cost.

U.S. Pat. No. 6,152,747, issued to Teradyne, Inc., discloses two mating connector halves of another type. Each connector disclosed therein comprises a dielectric housing defining a plurality of slots therein and a plurality of wafer-like modules retained in respective slots. Each wafer-like module includes a dielectric support and a plurality of signal and grounding contacts attached at its opposite sides, respectively. However, the connector of this type has difficulty in fulfilling the increasing demand of signal transmission of different electrical characteristics through the connector.

U.S. Pat. Nos. 6,267,604, 5,980,321, 6,293,827 and 6,299,484 each disclose an electrical connector providing a plurality of circuit boards to thereby achieve improved signal transmission of different electrical characteristics through the connector.

A connector disclosed in U.S. Pat. No. 6,267,604 comprises a front housing portion having a front wall with a plurality of parallel apertures extending therethrough, an organizer attached to the front housing portion and a plurality of individual circuit boards retained between the front housing portion and the organizer. The organizer has a plurality of spaced slots located corresponding to the apertures, and a plurality of openings communicating with the slots in a bottom wall thereof. The circuit boards have mating portions extending through the apertures of the front housing portion for mating with a complementary connector, and mounting edges received in the slots of the organizer. The mounting edges of the circuit boards have a plurality of terminals secured thereon by soldering. The terminals extend through respective openings of the organizer for electrically connecting with a circuit substrate.

However, the '604 patent has the shortcoming that connecting the terminals to the circuit boards is complicate and time-consuming. Furthermore, once the terminals are connected with the circuit boards, the terminals cannot be separated from the circuit boards. If the terminals or circuit boards are damaged, both of them must be replaced together, thereby increasing the cost of production. In addition, when the circuit boards are assembled to the organizer, the terminals secured on the circuit boards need to be received in the respective openings of the organizer for fixing the terminals, thereby increasing the difficulty of assemblage of the circuit boards.

Hence, an improved electrical connector is required to overcome the disadvantages of the related art.

SUMMARY OF THE INVENTION

Accordingly, a first object of the present invention is to provide a high density electrical connector having a plurality of individual circuit boards easily and reliably retained therein.

A second object of the present invention is to provide a high density electrical connector having a plurality of wafers assembled together for receiving a plurality of individual circuit boards.

A third object of the present invention is to provide a wafer assembly for an electrical connector, each individual wafer having a plurality of signal contacts and a grounding member respectively mounted on its opposite sides for mechanically and electrically contacting with a corresponding inserted circuit board.

In order to achieve the objects set forth, a high density electrical connector in accordance with the present invention comprises a dielectric housing defining a plurality of parallel channels therein, and a spacer consisting of a plurality of wafers assembled together. A plurality of slots is defined between adjacent wafers. Each wafer includes a dielectric base and a plurality of signal contacts and a grounding member respectively mounted on opposite sides of the dielectric base. A plurality of circuit boards is retained between the housing and the spacer. Each circuit board has a mating portion aligned with a corresponding channel of the housing for mating with a complementary connector, and a mounting portion received in a corresponding slot of the spacer. The mounting portions of the circuit boards mechanically and electrically contact with the signal and the grounding conductive elements of the spacer.

Other objects, advantages and novel features of the invention will become more apparent from the following detailed description when taken in conjunction with the accompanying drawings.

DETAILED DESCRIPTION OF THE INVENTION

Figure 1:
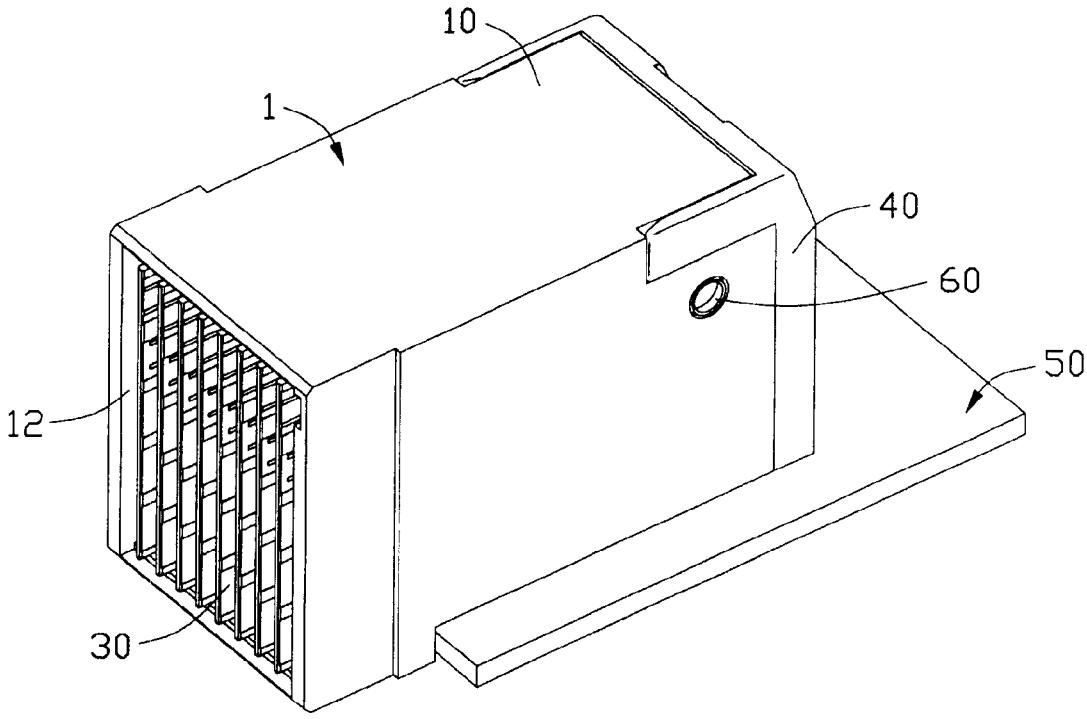
FIG. 1 is a perspective view of an electrical connector and a daughter card on which the connector is mounted in accordance with the present invention.

Referring to FIGS. 1–5, an electrical connector 1 mounted on a daughter card 50 in accordance with the present invention comprises a dielectric housing 10, a spacer 20, a plurality of circuit boards 30 retained between the housing 10 and the spacer 20, and a fastening device 40 for securing the spacer 20 to the housing 10. Each of the circuit boards 30 includes a dielectric substrate made of conventional circuit board substrate material, such as FR4, a plurality of conductive signal and grounding traces on one side of the substrate for providing electrical paths through the connector 1, and a layer of conductive material coated on an opposite side of the substrate for providing a grounding plane to the substrate.

Figure 6:
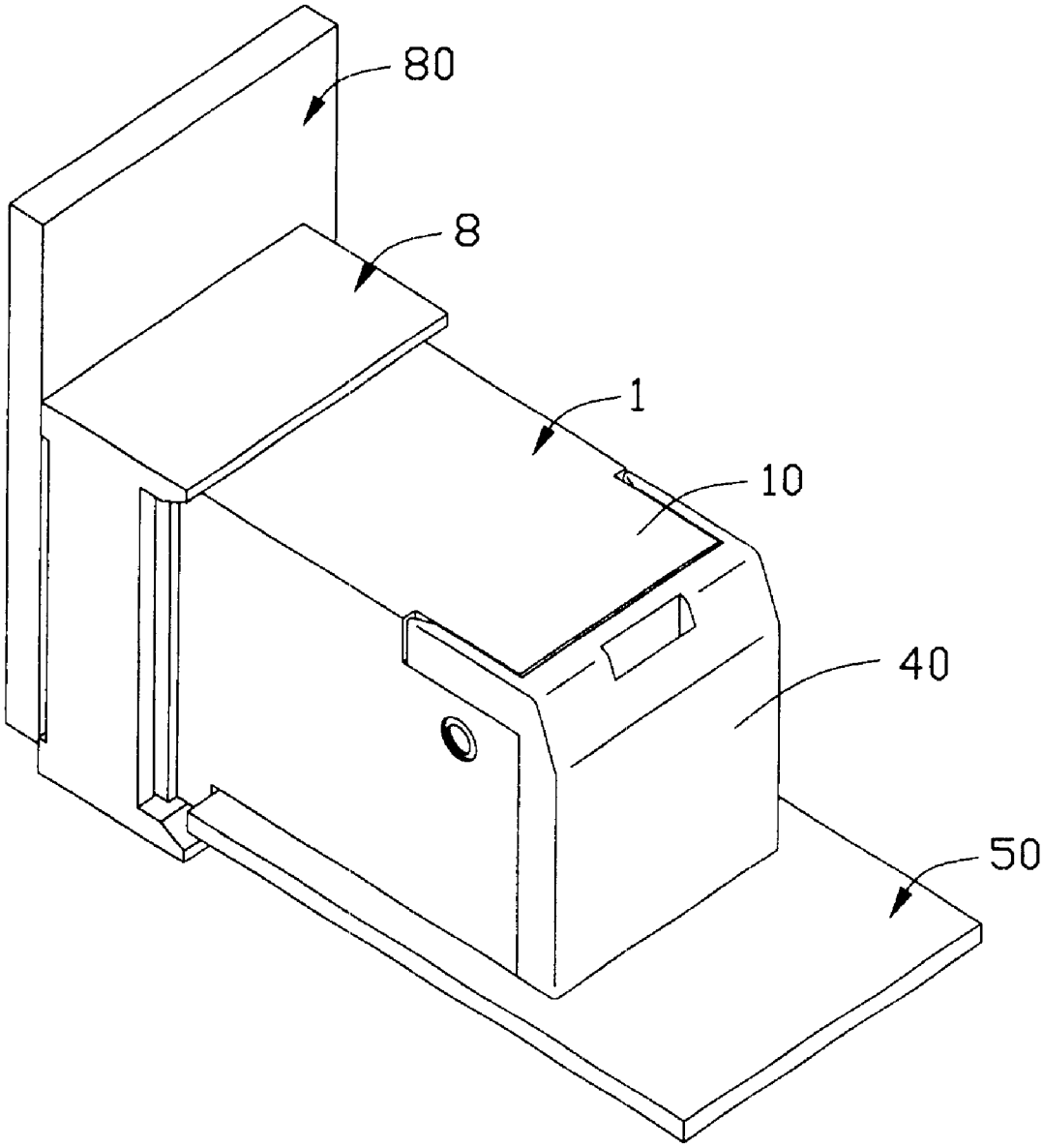
FIG. 6 is a perspective view showing the connector and the mating connector in a mated condition.

The dielectric housing 10 is generally in a rectangular shape. The housing 10 defines a front mating port 12 facing a complementary connector 8 (shown in FIG. 5) for connecting with a backplane 80 (FIG. 6). The connector 1 and the complementary connector 8, shown in a mated condition in FIG 6, serve to interconnect the daughter card 50 with the backplane 80. The housing 10 defines an opening 13 in a bottom face 100 and a rear face 102 thereof, and a plurality of parallel channels 14 in communication with the opening 13. The channels 14 extend in a longitudinal direction of the housing 10 between the front mating port 12 and the rear face 102. The housing 10 defines a pair of recesses 15 in opposite side faces 104 thereof adjacent to the rear face 102, and a pair of cavities 16 recessed from the recesses 15. An aperture 17 is defined transversely through the opposite side faces 104 of the housing 10 near the rear face 102.

The spacer 20 consists of a plurality of wafers 21. In the preferred embodiment, each one of the wafers 21 is identical in construction, an exemplary one thereof being shown in FIGS. 7 and 8. Each wafer 21 includes a dielectric base 22 and a plurality of signal terminals 23 and a grounding bus 24 respectively mounted on opposite sides of the dielectric base 22. The dielectric base 22 has a body portion 220 and front and rear end portions 222, 223. The rear end portion 223 has a top portion projecting upwardly beyond a top edge 224 of the body portion 220 to thereby form a shoulder 2220. The rear end portion 223 further defines a depression 2222 in a rear side thereof.

The body portion 220 of the dielectric base 22 has substantially planar side surfaces 2200, 2202. The body portion 220 forms a plurality of first and second blocks 25, 26 respectively on the side surfaces 2202, 2200. The first and the second blocks 25, 26 are located adjacent to a bottom surface 2204 of the body portion 220 in a staggered manner. Bottom faces of the first and the second blocks 25, 26 are flush with the bottom surface 2204 of the body portion 220 of the dielectric base 22. Each second block 26 includes a pair of ribs 262 and an embossment 264 located between the ribs 262. The side surface 2200 of the body portion 220 of the dielectric base 22 defines a plurality of slots 27 extending through the second blocks 26 to thereby running through a whole height of the body portion 220. The side surface 2200 of the dielectric base 22 also defines a plurality of recesses 28 adjacent to the top edge 224 of the body portion 220 between every two slots 27.

Figure 7:
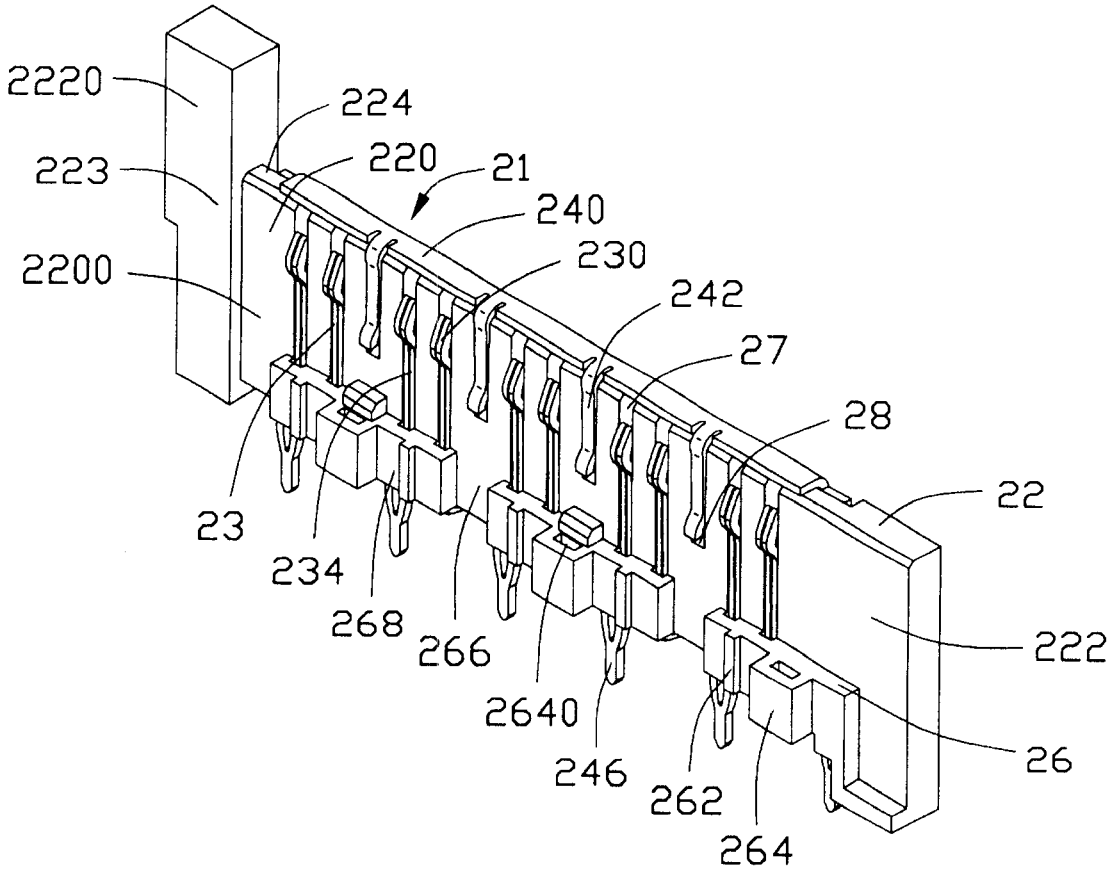
FIG. 7 is an enlarged perspective view of a wafer of the connector shown in FIG. 5.
Figure 8:
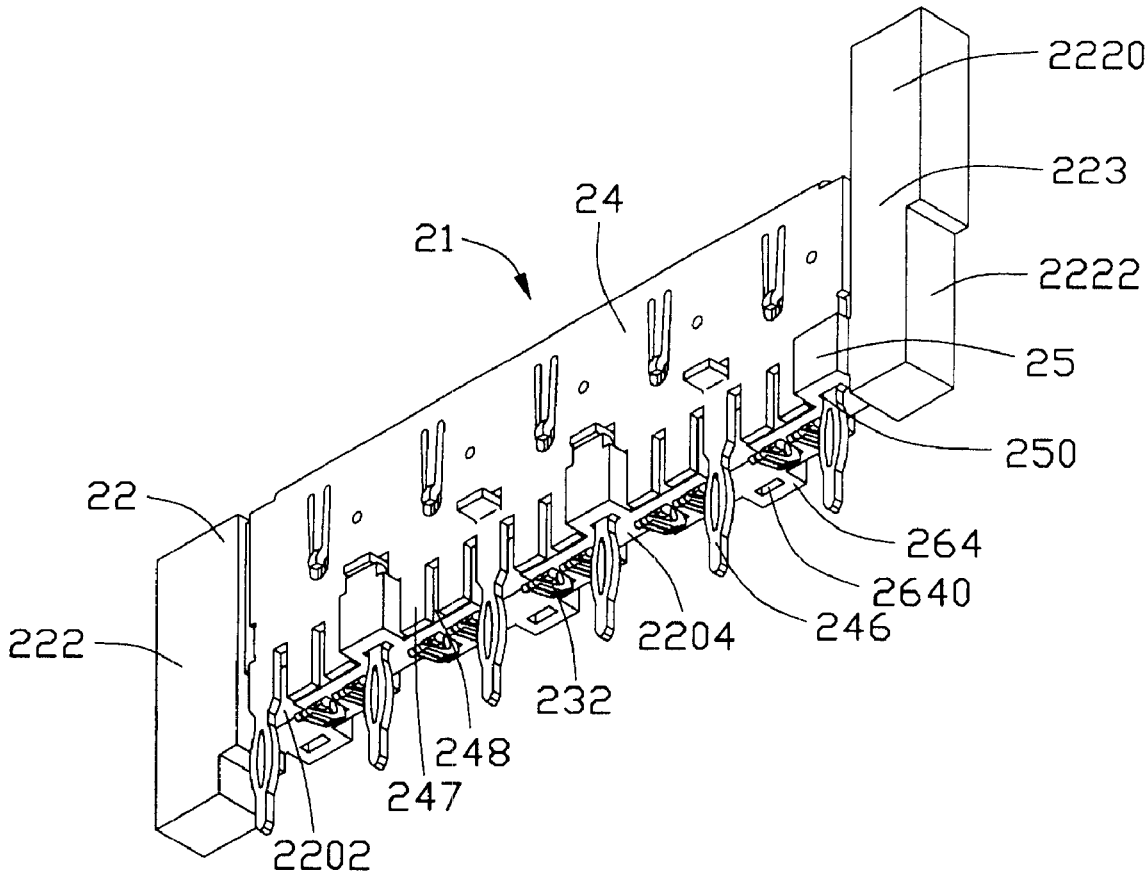
FIG 8 is a view similar to FIG. 7 but taken from a different aspect.
Figure 9:
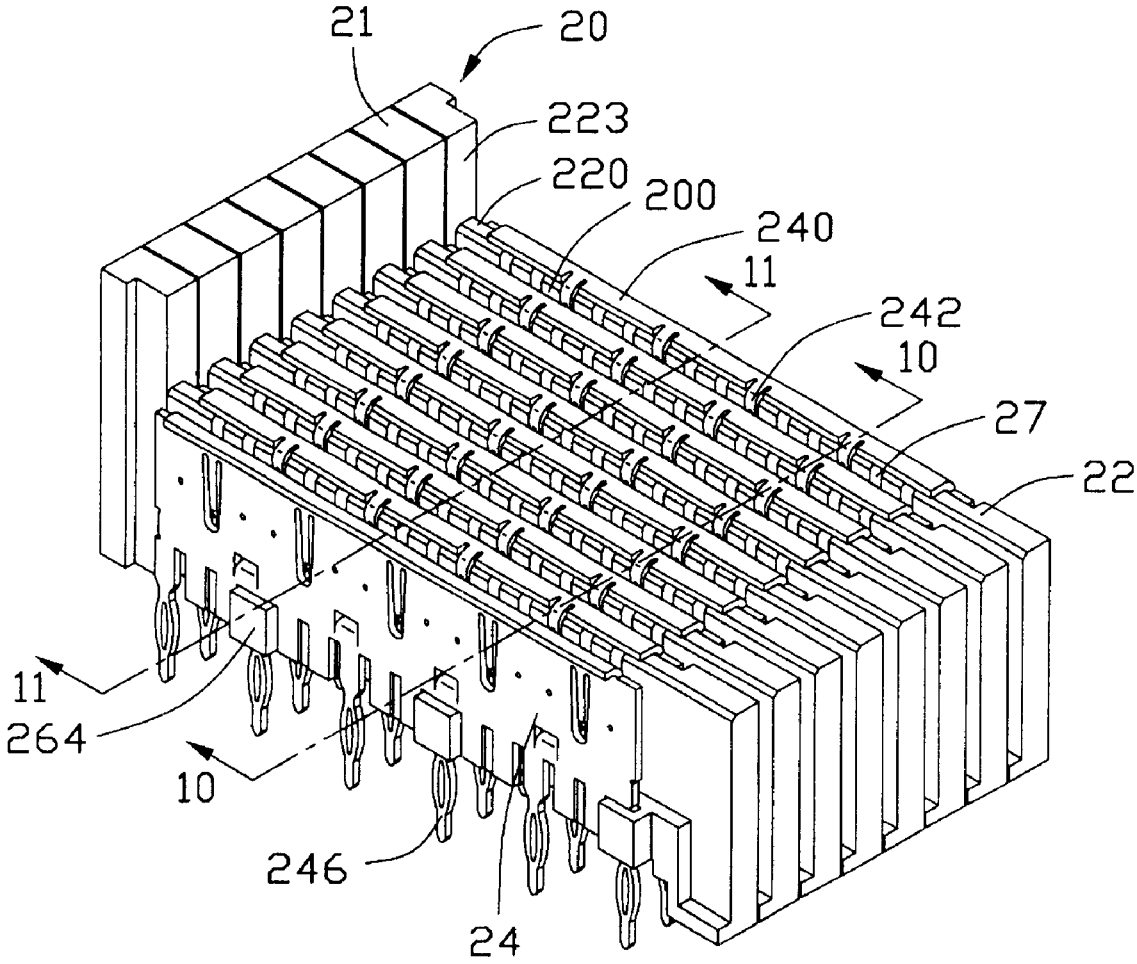
FIG. 9 is a perspective view showing a number of the wafer of FIG. 7 assembled together.
Figure 10:
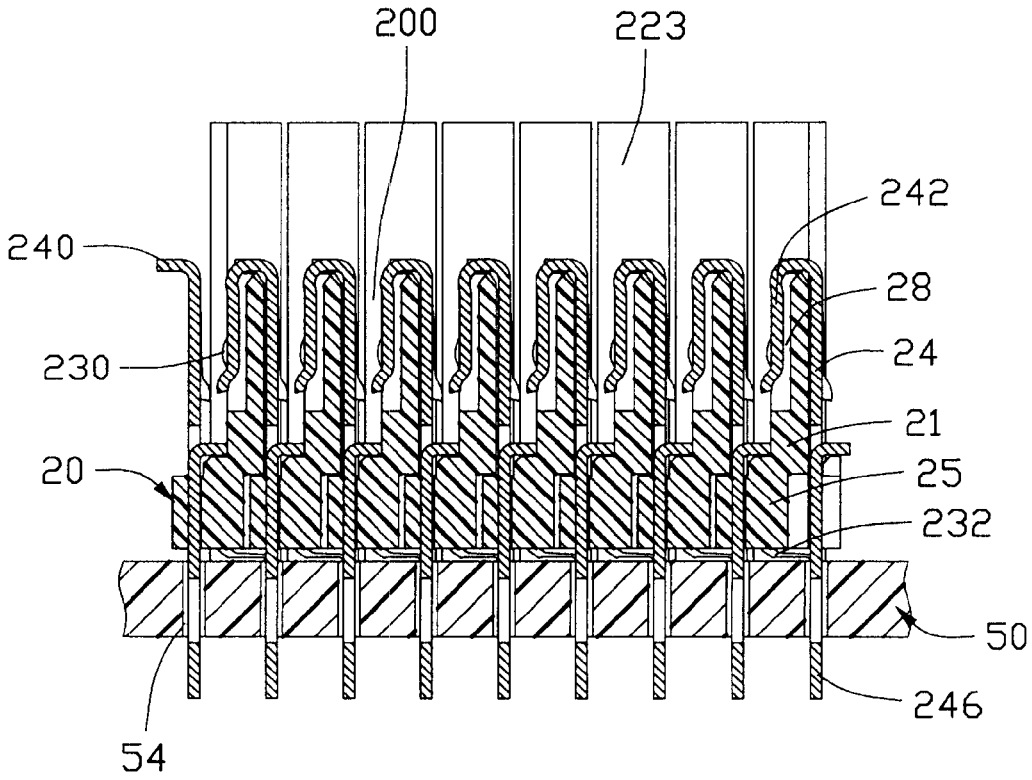
FIG. 10 is a cross-sectional view of the assembled wafers taken along section line 10—10 in FIG. 9 which are mounted on the daughter card.
Figure 11:
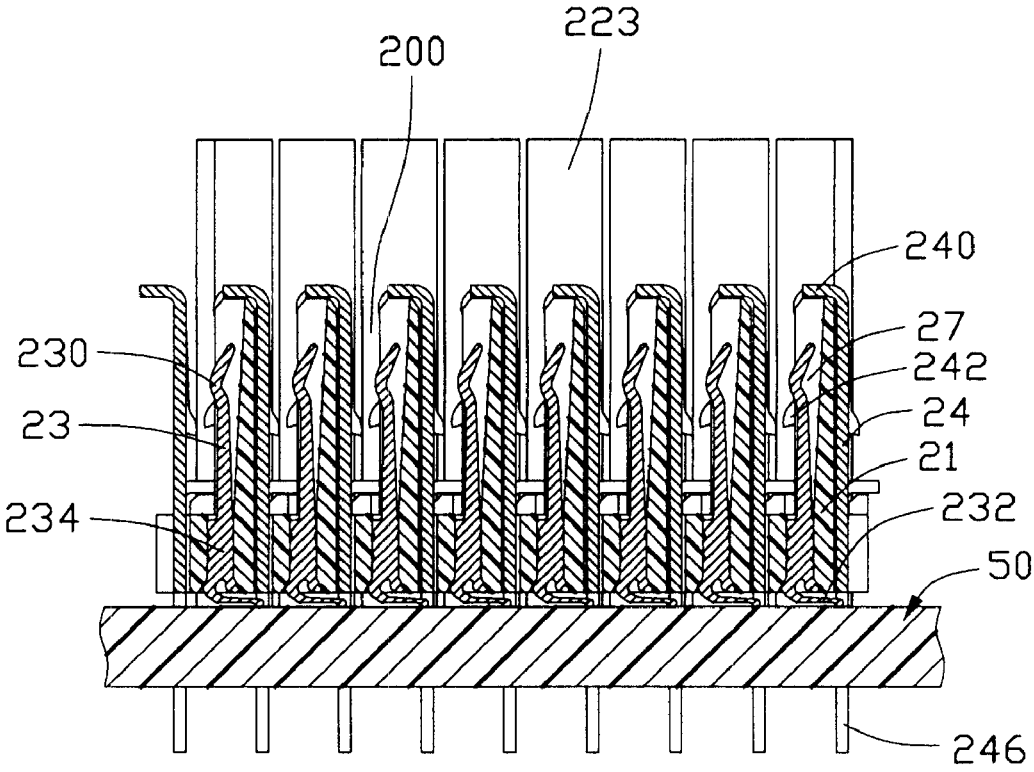
FIG. 11 is a view similar to FIG. 10 but taken along section line 11—11 in FIG. 9.

Referring to FIGS. 9–11 in conjunction with FIGS. 7 and 8, the plurality of wafers 21 are assembled together to form the spacer 20. A plurality of parallel slots 200 is defined between adjacent wafers 21 for receiving the circuit boards 30 therein. When assembling, the shoulders 2220 of the wafers 21 are aligned with each other, and the first blocks 25 of each wafer 21 have an interferential fit with corresponding recesses 266 formed between the second blocks 26 of an adjacent wafer 21.

Subsequently, the plurality of signal terminals 23 and the grounding buses 24 are assembled onto the spacer 20 to thereby make each wafer 21 with the signal terminals 23 received in the slots 27 in the side surface 2200, and with the grounding bus 24 disposed on the side surface 2202 of the wafer 21. Each slot 27 receives a pair of signal terminals 23 therein. The signal terminals 23 are stamped from a single piece of metal sheet. Each signal terminal 23 includes a curved contacting portion 230 raised outside of the side surface 2200 of the dielectric base 22 for contacting with the signal traces of an inserted circuit board 30, a bent tail portion 232 extending toward the side surface 2202 of the dielectric base 22, and an intermediate portion 234 interconnecting the contacting portion 230 with the bent tail portion 232. There exists a clearance (not labeled) between the bent tail portion 232 and the bottom surface 2204 of the dielectric base 22.

The grounding bus 24 is formed as a single piece snugly bearing against the side surface 2202 of the corresponding dielectric base 22. The grounding bus 24 has a top flange 240 covering the top edge 224 of the body portion 220, and a plurality of contacting legs 242 depending downwardly from the top flange 240 to be aligned with the recesses 28 of the dielectric base 22. A top end of each contacting leg 242 and the top flange 240 opposite to the contacting legs 242 respectively functions as a lead-in for facilitating insertion of the circuit board 30 into a corresponding slot 200. In addition, the grounding bus 24 has press-fit tails 246 for fittingly engaging with the daughter card 50. The tails 246 have a number which is the same as that of the first and the second blocks 25, 26 of the wafer 21. The grounding bus 24 also has several flaps 247 and slots 248 formed between two adjacent press-fit tails 246. The press-fit tails 246 extend beyond the bottom surface 2204 of the dielectric base 22 through apertures 250, 2640 respectively defined in the first blocks 25 of each wafer 21 and the second blocks 26 of an adjacent wafer 21. The flaps 247 of the grounding bus 24 are received in recesses 268 in the second blocks 26 of an adjacent wafer 21. Thus, the flaps 247 are disposed between the signal terminals 23 mounted on the two adjacent wafers 21 for functioning as a shell near ends of the signal terminals 23. The ribs 262 of the second blocks 26 of each wafer 21 are received in some of the slots 248 of an adjacent wafer 21.

Referring back to FIGS. 1–5, each of the circuit boards 30 has a mating portion 300, a mounting portion 302 and a rearward edge 304. After the spacer 20 is formed, the circuit boards 30 are respectively inserted into the slots 200 formed between the wafers 21. The mounting portion 302 of the circuit board 30 is received in a corresponding slot 200 for mechanically contacting with the signal terminals 23 and the grounding bus 24 of the wafer 21. Synchronously, the contacting portions 230 of the signal terminals 23 electrically contact with the signal traces on the circuit board 30, and the contacting legs 242 of the grounding bus 24 electrically contact with the grounding traces on the circuit board 30. The rearward edges 304 of the circuit boards 30 abut against the shoulders 2220 of the dielectric base 22.

The spacer 20 with the parallel circuit boards 30 received therein is then attached to the dielectric housing 10 in a back-to-front direction. The spacer 20 is received in the opening 13 of the housing 10. The channels 14 of the housing 10 guide the mating portions 300 of the circuit boards 30 into the mating port 12 of the housing 10. Finally, the fastening device 40 is attached to the housing 10 for fixing the spacer 20 with the housing 10. The fastening device 40 includes a rear wall 400 covering with the rear face 102 of the housing 10, and a pair of latches 402 forwardly extending from opposite side edges of the rear wall 400. Each latch 402 has a hook 404 at a free end thereof. The latches 402 are received in the recesses 15 of the housing 10 and the hooks 404 are locked in the cavities 16 of the housing 10. The rear wall 400 has a protrusion 406 on an inner face thereof for abutting against a top face of the depression 2222 of the spacer 20, whereby the housing 10 and the spacer 20 are stably connected with each other. A cylinder pin 60 is inserted into through holes 32 of the circuit boards 30 through the aperture 17 of the housing 10 for keeping the circuit boards 30 in their original position rather than be pushed back when the connector 1 mates with the complementary connector 8. It is noted that the spacer 20 can also be adopted to form the complementary connector 8, thereby reducing the manufacturing cost.

Figure 2:
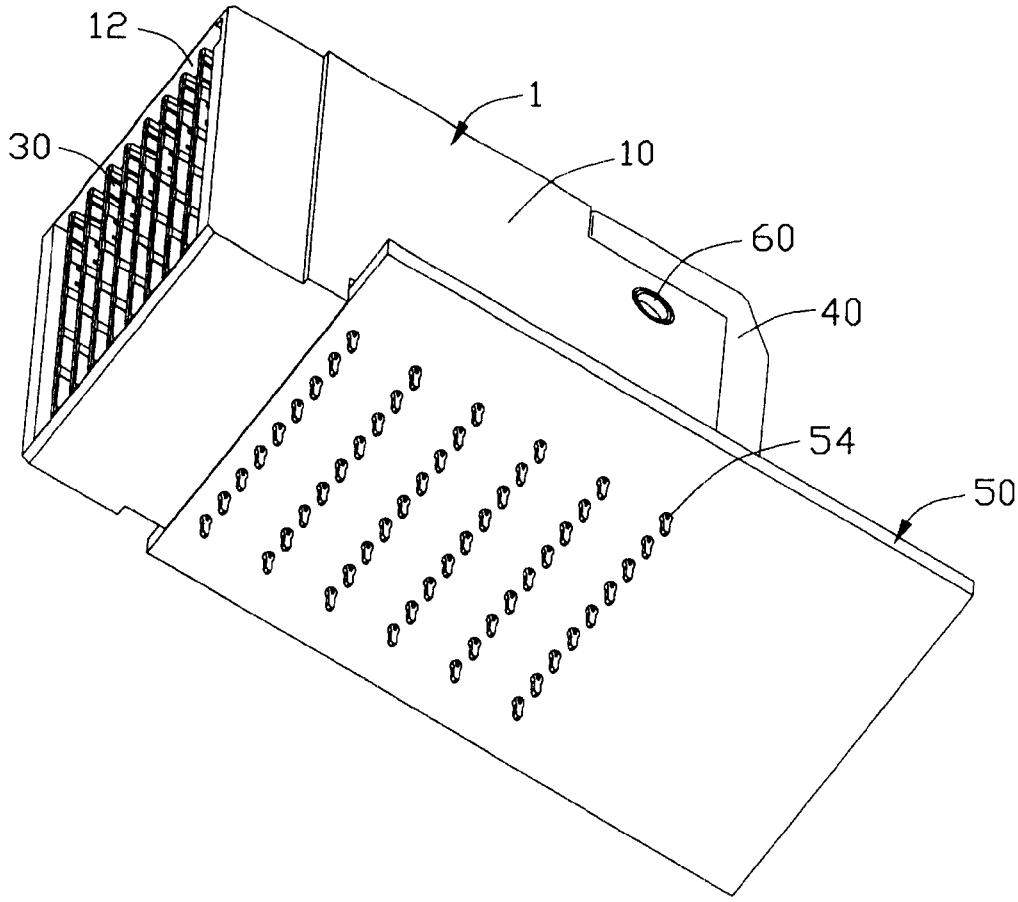
FIG. 2 is a view similar to FIG. 1 but taken from a different perspective.
Figure 3:
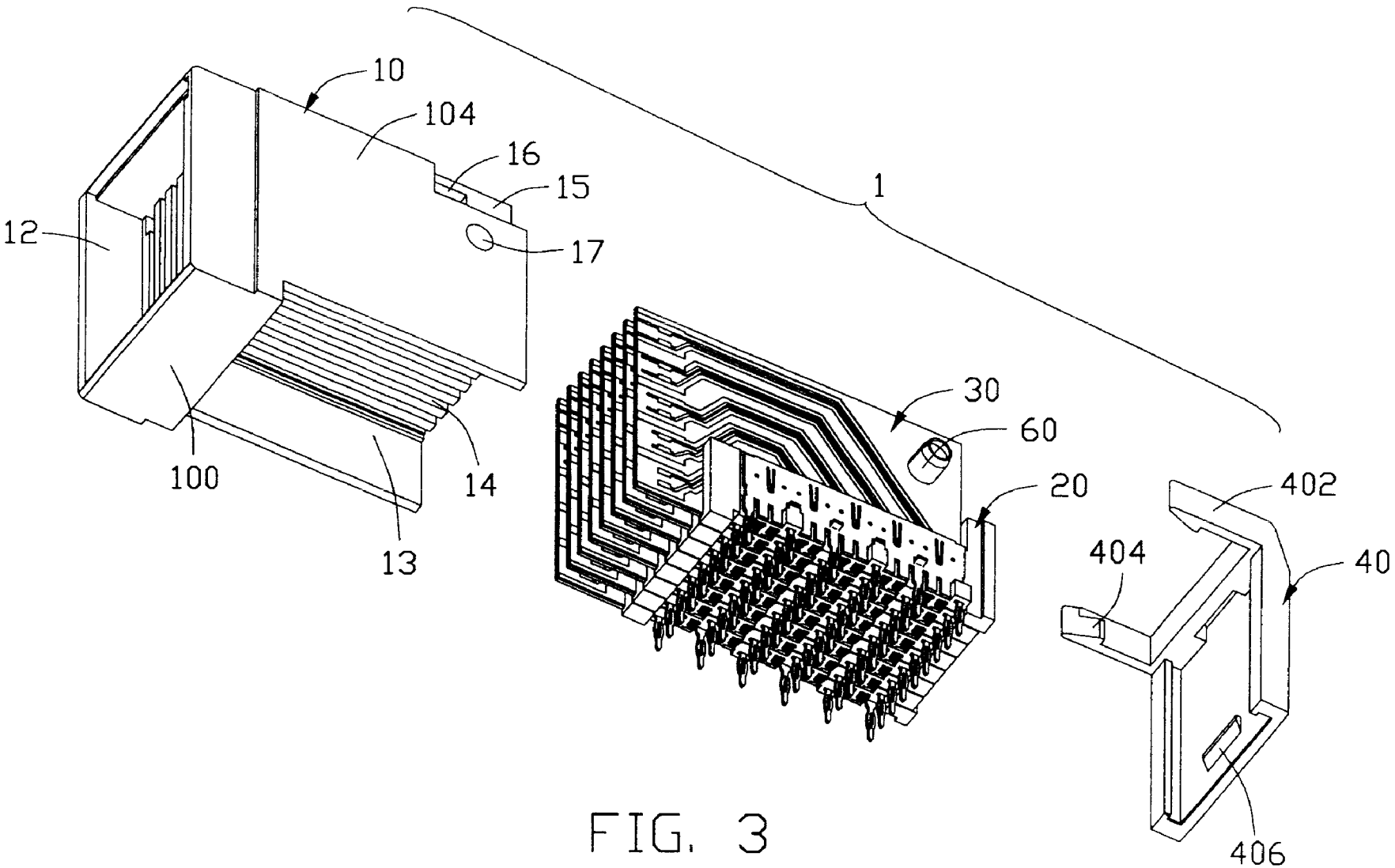
FIG. 3 is a partially exploded view of the connector.
Figure 4:
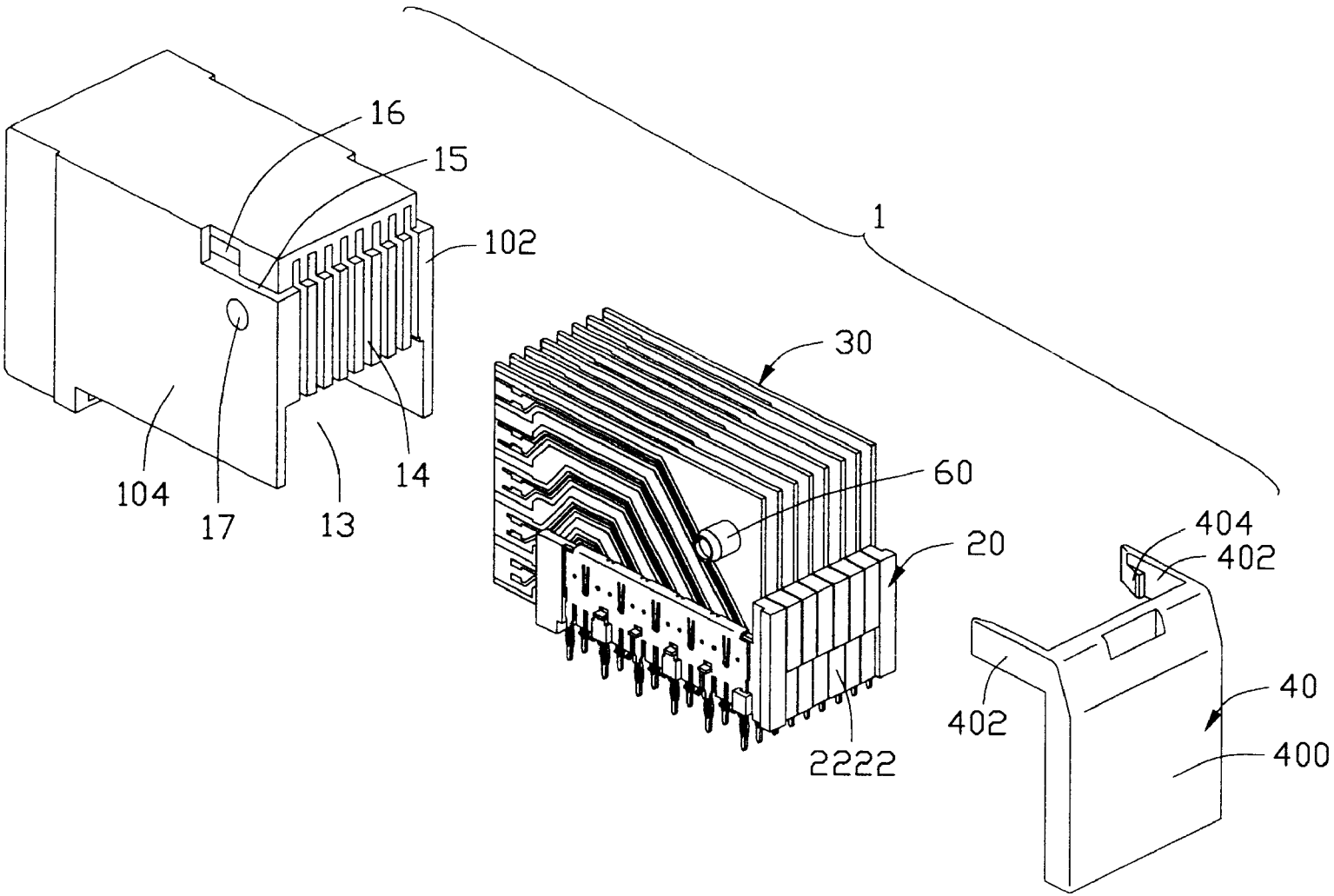
FIG. 4 is a view similar to FIG. 3 but taken from a different perspective.
Figure 5:
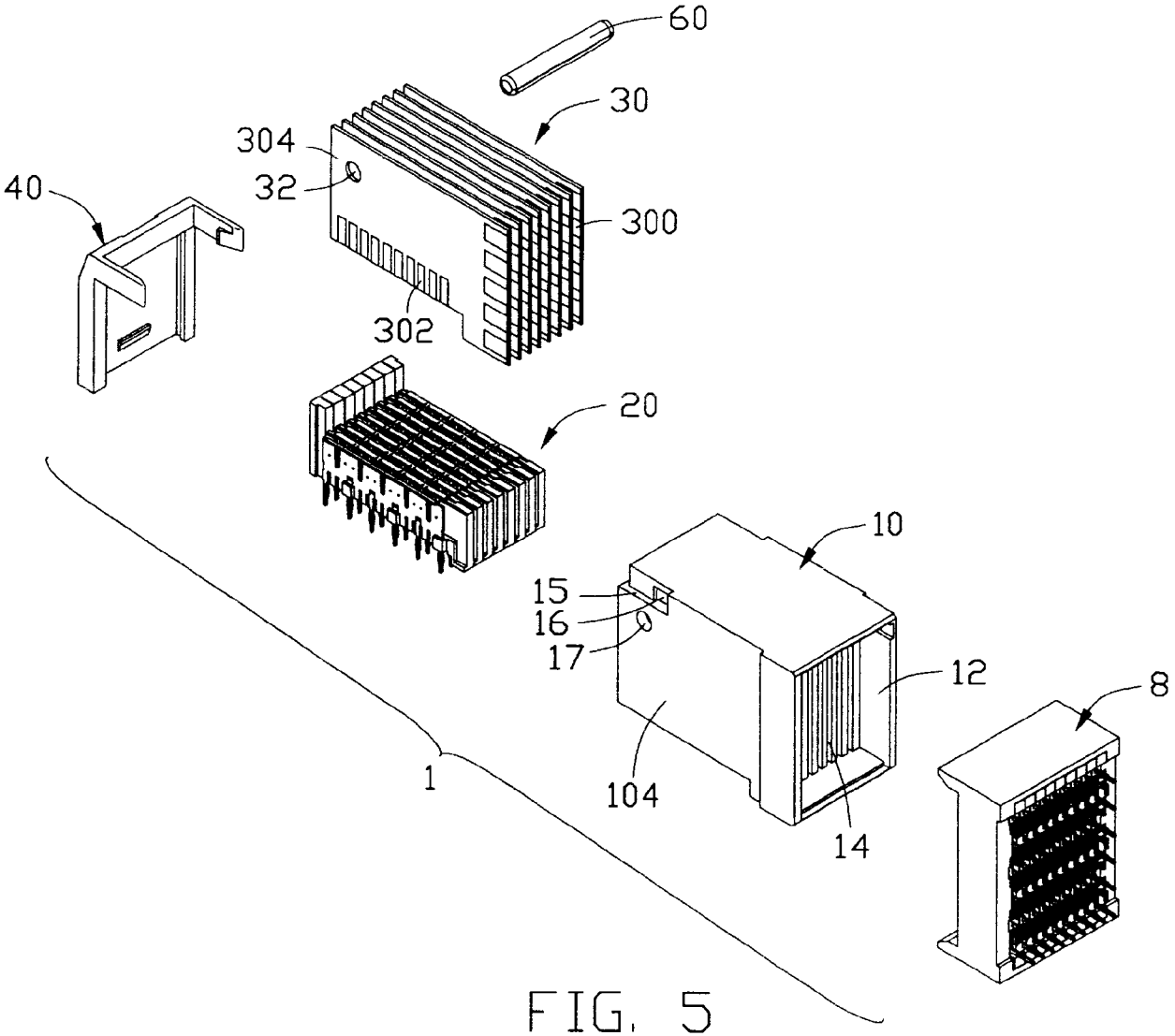
FIG. 5 is an exploded view of the connector of the present invention and a complementary mating connector.
Figure 12:
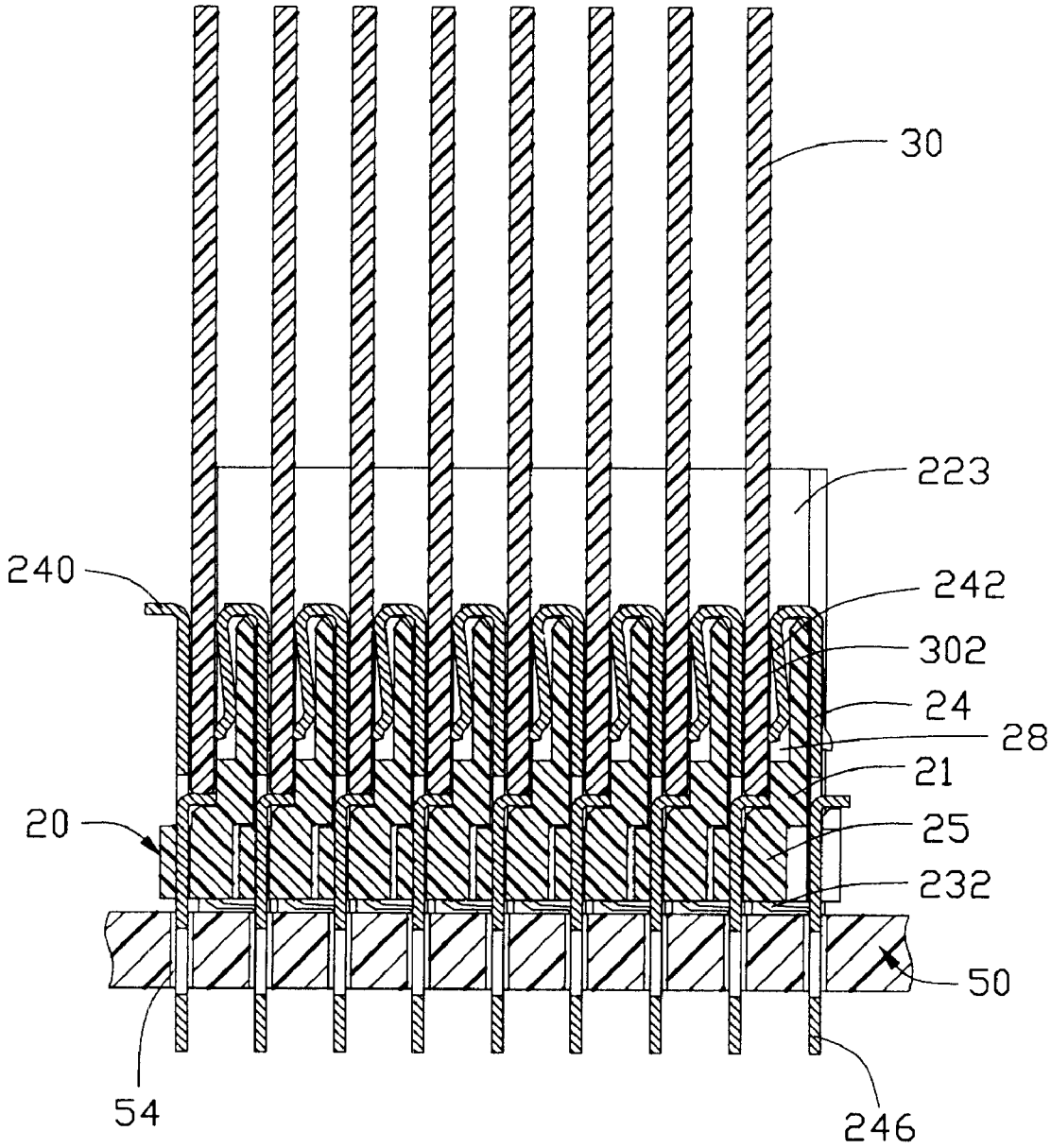
FIG. 12 is a view similar to FIG. 10 with circuit boards being inserted into the wafers.

Referring to FIGS. 10–12 in conjunction with FIGS. 1–2, the connector 1 is mounted on the daughter card 50 to establish an electrical connection therebetween. The press-fit tails 246 of the grounding bus 24 are interferentially received in plated through holes 54 of the daughter card 50. The press-fit tails 246 of the grounding bus 24 not only establish grounding traces between the connector 1 and the daughter card 50, but also sufficiently hold the connector 1 against movement relative to the daughter card 50. At the same time, the bent tail portions 232 of the signal terminals 23 are compressibly engaged with signal pads (not shown) on the daughter card 50 for establishing signal traces between the connector 1 and the daughter card 50.

It is noted that the connector 1 has a plurality of grounding buses 24 disposed between adjacent rows of the signal terminals 23, and each of the circuit boards 30 located between adjacent rows of the signal terminals 23 has the grounding traces and the grounding plane respectively on the opposite sides of the circuit board. Both the grounding buses 24 and the grounding traces and the grounding planes on the circuit boards 30 function as shielding between adjacent rows of the signal terminals 23 to thereby achieve better electrical performance of the connector 1. In addition, the circuit boards 30 received in the spacer 20 are only engaged with the signal terminals 23 and the grounding buses 24 of the wafers 21. Due to elasticity of the signal terminals 23 and the contacting legs 242 of the grounding buses 24, the circuit boards 30 are floatingly received in the spacer 20 and are electrically connected with the signal terminals 23 and the grounding buses 24. In other words, no additional retention mechanism is needed to fix the mounting portion 302 of the circuit board 30 in the connector 1, thereby facilitating assembling the circuit boards 30 into the connector 1 and reducing the manufacturing cost.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for being mounted on a printed circuit board, comprising:

a spacer including a plurality of individual wafers assembled together to define a plurality of slots between adjacent wafers, each wafer including a dielectric base and a plurality of signal contacts and a grounding member respectively mounted on opposite sides of the dielectric base, the signal contacts and the grounding member having tail portions for connecting to a printed circuit board and contacting portions located at the same side of the dielectric base; and a plurality of circuit boards received in the slots of the spacer, each circuit board having a mounting portion mechanically and electrically engaging with the contacting portions of the signal contacts and the grounding member and having no engagement with corresponding dielectric bases of the wafers.

2. An electrical connector comprising:

a dielectric housing defining a plurality of parallel channels extending in a first direction of the housing, and an aperture extending through the housing in a second direction substantially perpendicular to the first direction;

a plurality of individual circuit boards received in the channels of the dielectric housing, each circuit board defining a through hole aligned with the aperture of the housing; and a fastening element inserted into the through holes of the circuit boards through the aperture of the dielectric housing, the circuit boards being stringed by the fastening element and the fastening element being fastened to the dielectric housing, thereby retaining the circuit boards in the housing.

* * * * *